US009783966B2

(12) United States Patent
Bosio

(10) Patent No.: US 9,783,966 B2
(45) Date of Patent: Oct. 10, 2017

(54) JET BREAKER/AERATOR CARTRIDGE WHICH CAN BE MANUALLY DISASSEMBLED AND FAUCET COMPRISING SAID CARTRIDGE

(71) Applicant: AMFAG S.r.l., Casaloldo (MN) (IT)

(72) Inventor: Orlando Bosio, Casaloldo (IT)

(73) Assignee: AMFAG S.r.l. (IT)

( * ) Notice: Subject to any disclaimer, the term of this patent is extended or adjusted under 35 U.S.C. 154(b) by 0 days.

(21) Appl. No.: 14/973,332

(22) Filed: Dec. 17, 2015

(65) Prior Publication Data

US 2016/0177553 A1 Jun. 23, 2016

(30) Foreign Application Priority Data

Dec. 22, 2014 (IT) ..... M12014A2217

(51) Int. Cl.
*E03C 1/00* (2006.01)
*E03C 1/084* (2006.01)
*E03C 1/086* (2006.01)

(52) U.S. Cl.
CPC ..... *E03C 1/084* (2013.01); *E03C 1/086* (2013.01)

(58) Field of Classification Search
CPC ..... E03C 1/08; E03C 1/084; E03C 1/086
USPC ..... 285/8; 239/428.5, 553.3
See application file for complete search history.

(56) References Cited

U.S. PATENT DOCUMENTS 3,684,190 A * 8/1972 Bletcher ..... E03C 1/08 239/428.5
2009/0263184 A1 10/2009 Riedel et al.
2013/0082122 A1* 4/2013 Stein ..... E03C 1/084 239/428.5

FOREIGN PATENT DOCUMENTS

EP 0 631 020 B1 6/1999
EP 2 154 299 A2 2/2010
GB 2 109 507 A 6/1983
GB 2 505 257 A 2/2014

OTHER PUBLICATIONS

Italian Search Report issued in connection with MI2014A002217.

* cited by examiner

*Primary Examiner* — Arthur O Hall
*Assistant Examiner* — Viet Le
(74) *Attorney, Agent, or Firm* — Akerman LLP

(57) ABSTRACT

A jet breaker/aerator cartridge, manually screwable about a screwing axis (x) within the mouth of a faucet. The cartridge has an external casing made of preferably plastic material and an engagement portion provided with a thread on its external surface for screwing the cartridge within the mouth, and a gripping portion which extends downstream with respect to the engagement portion. The gripping portion has at least one radial protrusion protruding with respect to a central cylindrical body of the gripping portion. The radial protrusion allows application of a manual screwing force with an arm advantageously far from the screwing axis (x).

17 Claims, 6 Drawing Sheets

JET BREAKER/AERATOR CARTRIDGE WHICH CAN BE MANUALLY DISASSEMBLED AND FAUCET COMPRISING SAID CARTRIDGE

CROSS-REFERENCE TO RELATED APPLICATIONS

The present application claims priority to Italian Patent Application No. MI2014A002217, filed Dec. 22, 2014, the entirety of which is incorporated herein by reference.

FIELD OF APPLICATION

The present invention relates to a jet breaker/aerator cartridge and to a faucet comprising said cartridge.

This device is designed to be positioned at the outlet of a duct, in particular of a faucet, in order to make the jet more uniform and softer, therefore being used in the sector of hydraulic components.

PRIOR ART

Aerator devices are nowadays widespread in the sector of domestic and industrial taps and faucets owing to the many advantages which they offer in exchange for low costs.

Jet breaker aerators are called such because they are formed by a series of perforated plates and screening elements which divide up the jet and allow it to be mixed with the air, so as to obtain a water flow which is perfectly cylindrical and frothy.

For the same diameter of the liquid column, considerable savings are also achieved in terms of the amount of water supplied.

Typically these devices, which are realized in the form of small-size cartridges, are mounted inside an end ring nut of the faucet, so as to allow rapid and easy replacement thereof by the user.

Recently new solutions have been developed with the aim of avoiding the use of the aforementioned end ring nut, the presence of which in some cases negatively affects the elegant and essential design of some tap and faucet articles and which moreover constitutes a not insignificant cost, since it is made of brass which is nearly always chrome-plated. The jet breaker aerator cartridge is these cases directly screwed within the previously masked end section of the faucet mouth.

Documents relating to these types of device and their structure may be easily found, such as EP 0,631,020.

In view of the nature of the device it is evident that it may be subject to frequent and prolonged operation and the passage of the water flows from the pipes exposes it to the action of lime scale and other solid residue which is transported by the fluid.

Assembly and/or disassembly operations for ordinary maintenance are therefore envisaged and are taken into account during the practical design of these devices.

Nevertheless these operations are not easy mainly because of the structure of the aerator which, in order to be fitted onto the mouth of the faucet, requires a threaded connection member, which is generally made of chrome-plate brass like the faucet itself.

The contact between two surfaces made of metallic material produces a very stable connection which, already under design conditions, requires the assistance of tools to screw or unscrew the device.

In addition, over the time, the thread of the aerator may become seized with the thread of the faucet, making it necessary to apply force to the device with the risk of damaging it.

As regards the unscrewing tools in some cases the product which is sold is supplied together with tools or spanners which have been specially designed for the specific device, as for example proposed in the patent applications EP 2,154,299 A and WO 2011/154063 A.

These tools, since they are not frequently used and perform a single function, are often lost by the consumer and are not always easy to find on the market.

In such cases, if the device projects by a sufficient amount from the mouth of the faucet, it may be disassembled with a normal set of pliers which, however, tends to deform and scratch the chrome-plated ring nut.

The technical problem forming the basis of the present invention is therefore to develop a jet breaker aerator device which may be manually mounted on or removed from the mouth of the faucet without the aid of any tool or other means, such that the maintenance operation may be readily performed.

SUMMARY OF THE INVENTION

The aforementioned technical problem is solved by a jet breaker/aerator cartridge, screwable about a screwing axis within the mouth of a faucet and comprising an external casing, preferably made of plastic material and having, from upstream to downstream with respect to the flow path defined inside it, an externally threaded engagement portion and a gripping portion; this gripping portion in turn comprises a central body and at least one radial protrusion protruding therefrom, so as to define a pushing surface for an operator's fingers and allow manual screwing and unscrewing of the cartridge.

A person skilled in the art will understand how a plastic casing, preferably of the self-lubricating type, results in a reduced coefficient of friction with the metal of the mouth in the region of the threaded connection. The provision of radial guide surfaces which are accessible for the operator's fingers, together with the aforementioned reduced coefficient of friction, allows a tightening or loosening torque to be easily exerted, which is sufficient for positioning or removal of the device in the event of maintenance, without the use of any dedicated tool.

In this way the maintenance operations are significantly facilitated.

Moreover, the dedicated production of unscrewing tools thus becomes unnecessary, thereby reducing the production costs and overheads.

The cartridge may also have one or more abutments for restraining the motion of the cartridge within the mouth, so as to define a fastened arrangement in which the gripping portion extends at least partially outside the mouth.

Correct positioning along the screwing axis is thus ensured, namely the cartridge is prevented from being able to move up inside the duct of the faucet by an amount such as to no longer allow manual removal thereof.

In effect, in said fastened position, the pushing surfaces protrude preferably outside the mouth, so as to be accessible for the operator's fingers without the need to use tools to be introduced inside the mouth of the faucet.

Preferably, a pushing direction orthogonal to said pushing surface and eccentric with respect to said screwing axis by an arm at least equal to the radius of the central cylindrical body is provided.

Owing to this arrangement, when the operator presses the pushing surface, a torque with an advantageously high arm is applied.

Preferably there are at least two said radial protrusions, diametrically opposed with respect to the central cylindrical body, each of said radial protrusions having a respective pushing surface.

In this way the grip (between index finger and thumb) is facilitated and the operator may exert a greater tightening/loosening torque.

In a first embodiment, said central cylindrical body may have a diameter smaller than the engagement portion thereabove, said radial protrusions being two projections with a diameter equal to the engagement portion.

In an alternative embodiment, said central cylindrical body has a diameter equal to the engagement portion, said radial protrusions being longitudinal tabs.

In yet another alternative embodiment, said radial protrusions are teeth, abutting against the mouth in a fastened arrangement of the cartridge.

Preferably, the radial protrusions are located or extend as far as the free end of the gripping portion or of the central body thereof.

As specified above, the material chosen for manufacture of the external casing is preferably a self-lubricating plastic, for example polyoxymethylene (POM) which, being flexible and having a low coefficient of friction, prevents the risk of seizing between the surfaces of the threads or the possibility of the device being permanently deformed or scratched.

Said external casing is moreover preferably monolithic, said central cylindrical body internally defining a cup containing at least some of the jet breaking and aeration means.

The aforementioned technical problem is also solved by a faucet comprising: a faucet body provided with a water outlet mouth; and a jet breaker/aerator cartridge of the aforementioned type; wherein the thread of said engagement portion is screwed about a screwing axis within a corresponding inner thread inside the mouth; said at least one pushing surface being accessible to an operator's fingers so as to allow manual unscrewing of the cartridge from the mouth.

Preferably, the pushing surface extends at least partially outside the mouth, so as to allow contact thereupon by an operator's fingers.

Further characteristic features and advantages will emerge more clearly from the detailed description provided hereinbelow of a number of preferred, but not exclusive embodiments of the present invention, with reference to the attached figures, provided by way of a non-limiting example.

DETAILED DESCRIPTION

With reference to the attached FIGS. 1-3B and 6, a jet breaker/aerator cartridge is denoted generically by 1. The cartridge is shown seated in an operating position within an end section of a faucet, below referred to as mouth 100.

Figure 4:
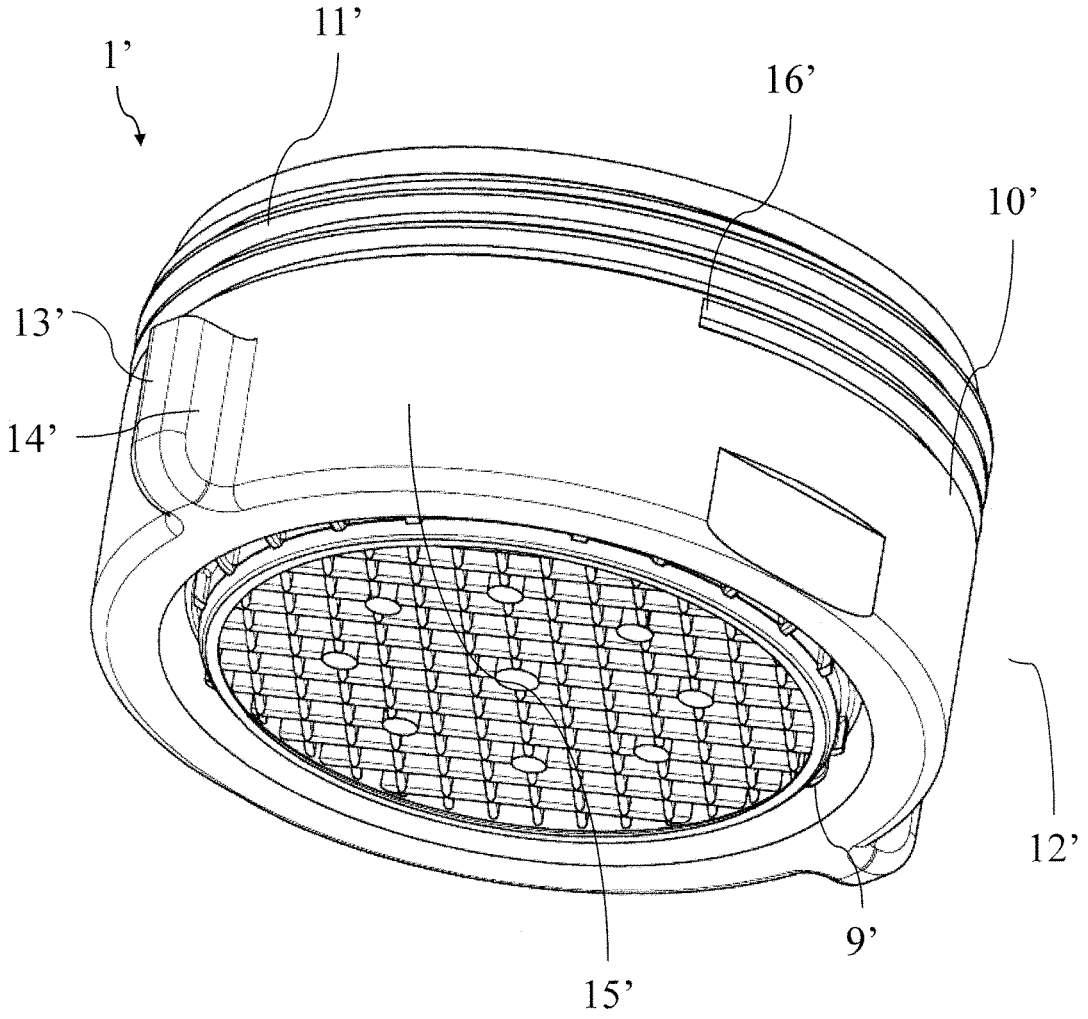
FIG. 4 shows a perspective view of a jet breaker/aerator cartridge in accordance with a second embodiment, screwed within the mouth of a faucet.
Figure 5:
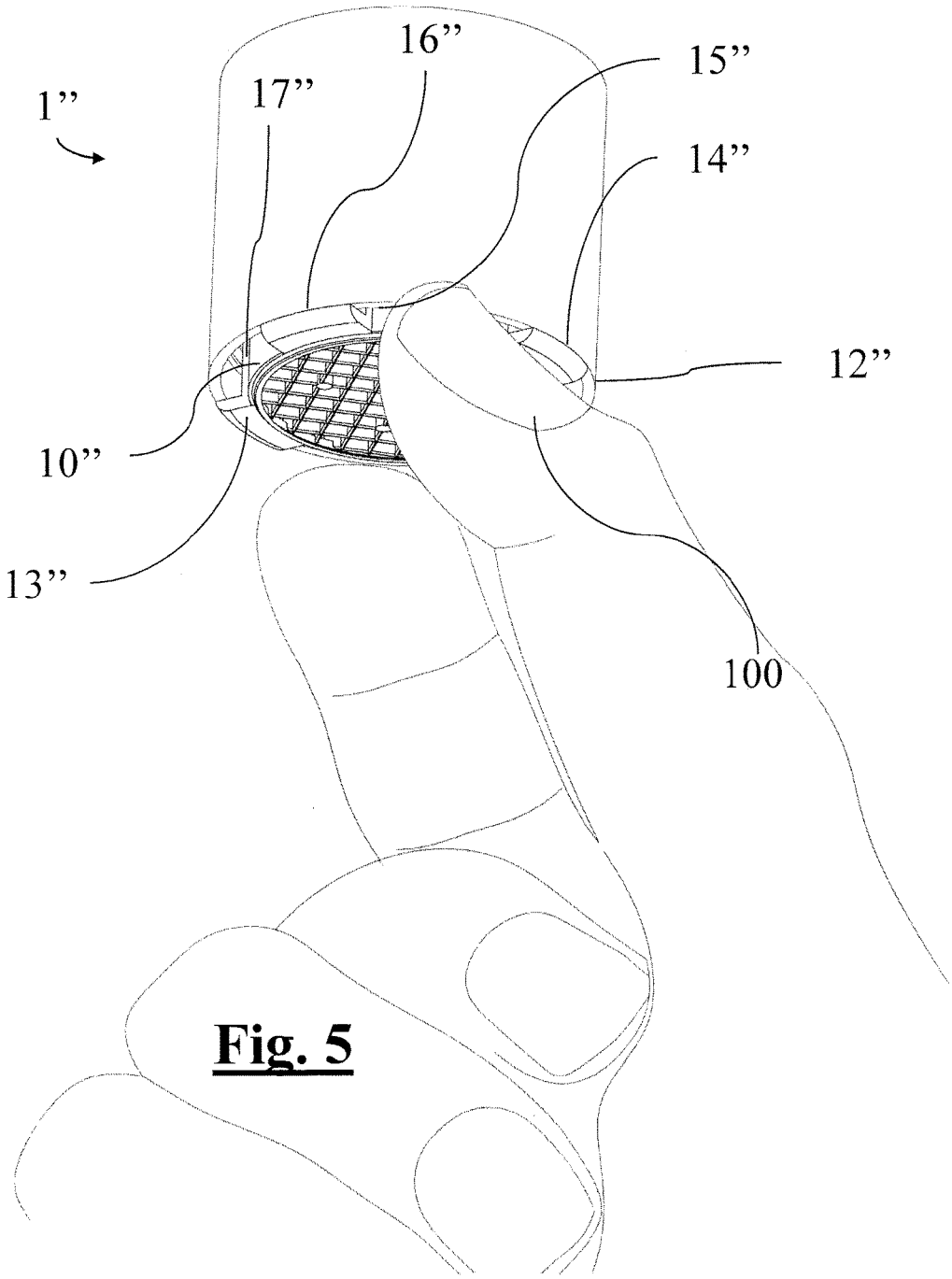
FIG. 5 shows a perspective view of a jet breaker/aerator cartridge in accordance with a third embodiment.

Alternative embodiments of the same cartridge, indicated by 1' and 1", are also illustrated in the remaining FIGS. 4 and 5.

The mouth 100 in the examples illustrated is a tubular end section of a faucet; however, this characterization is purely illustrative, since the sole part of the mouth 100 which is relevant for the invention is the internally threaded bottom part inside which the cartridge 1 is introduced. Thus, the mouth 100 may be made with various shapes and in particular may be formed as one piece with the rest of the duct of the faucet which is not shown in the figures.

Figure 1:
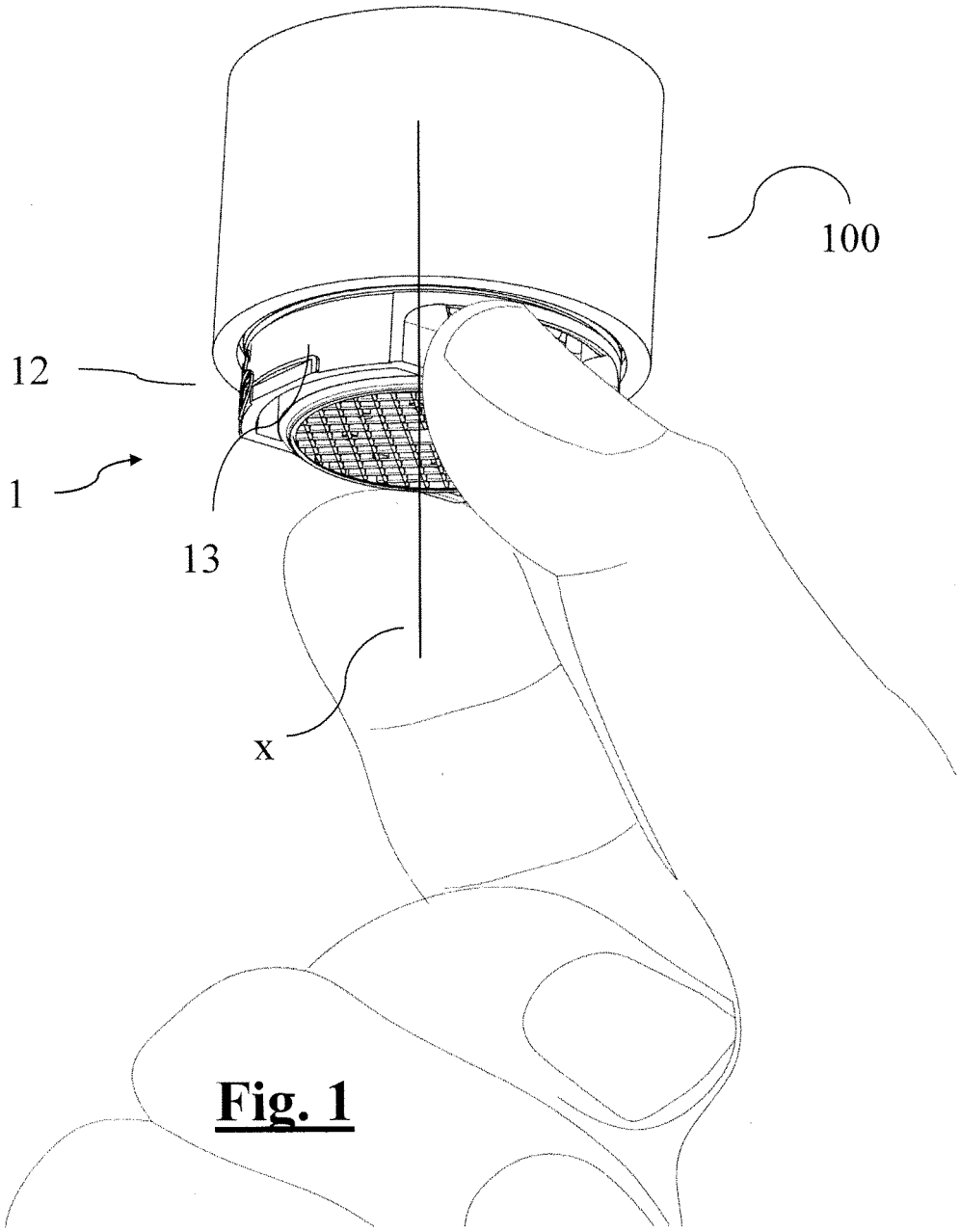
FIG. 1 shows a perspective view of a jet breaker/aerator cartridge screwed within the mouth of a faucet.
Figure 2A:
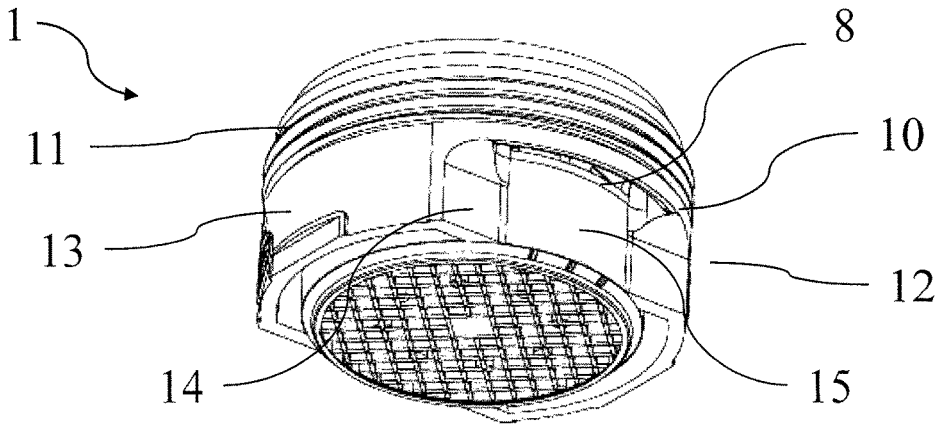
FIG. 2A shows a perspective view from below of solely the jet breaker cartridge according to FIG. 1.
Figure 2B:
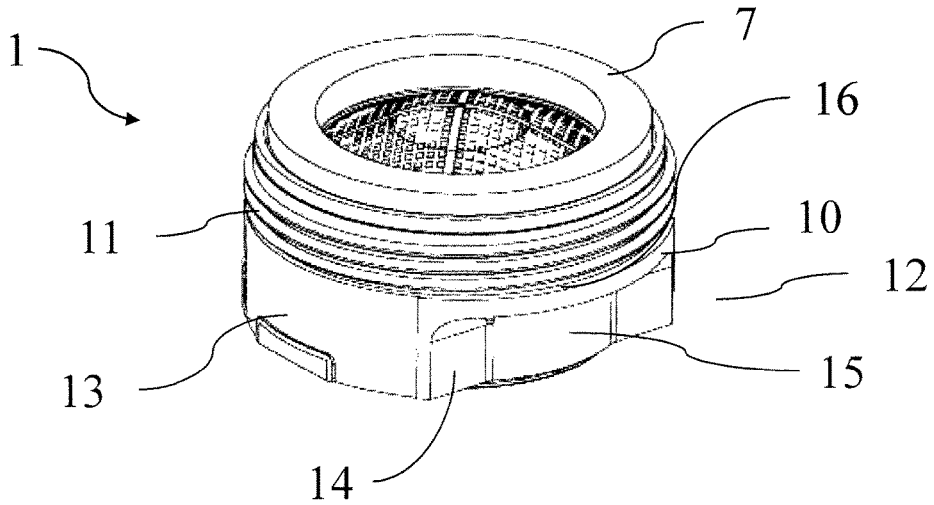
FIG. 2B shows a perspective view from above of solely the jet breaker cartridge according to FIG. 1.

The cartridge 1 and the mouth 100 are shown in FIG. 1 in a specific vertical operative configuration; in the continuation of the present description, the relative and absolute positions and orientations of the various elements which form the unit—defined by means of terms such as "upper" and "lower", "above" and "below", "horizontal" and "vertical" or other equivalent terms, must always be interpreted with reference to this configuration. In no case, therefore, must any limiting value be attributed to them. The same applies to the cartridges 1', 1" which are shown in FIGS. 4 and 5, also in a vertical reference configuration.

In the first embodiment, shown in FIGS. 1-3B and 6, the jet breaker/aerator cartridge 1 is screwable about a screwing axis x within the mouth 100 of a faucet and comprises an external casing 10 which defines therein a flow path 2 extending between an upstream inlet 21 and a downstream outlet 22.

Various functional components, which are generically indicated below as breaking and aeration means 3, 4, 5, designed to break up and enrich with air the water jet which strikes them, are present inside the aforementioned external casing 10.

Figure 3A:
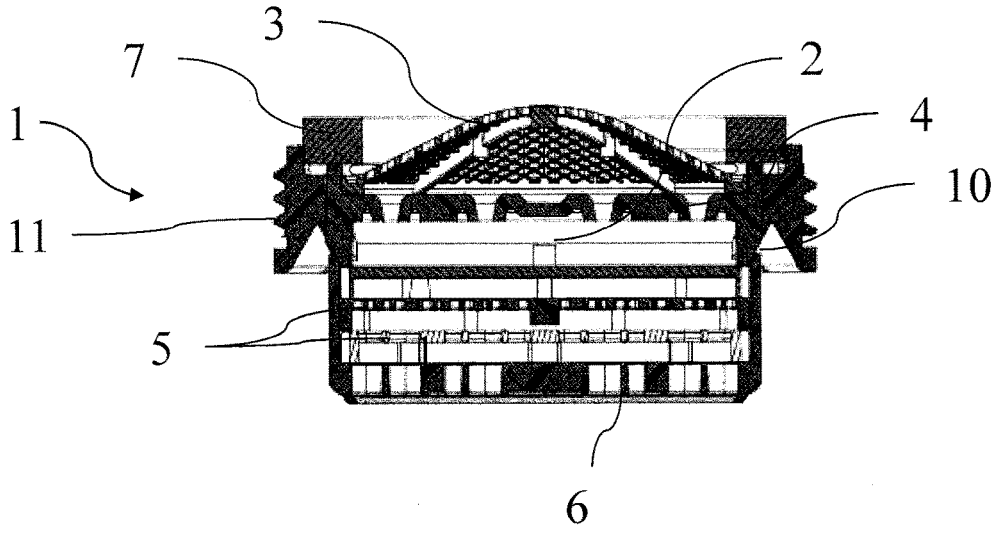
FIG. 3A shows a cross-sectional view along a first center plane of the jet breaker cartridge according to FIG. 1.
Figure 3B:
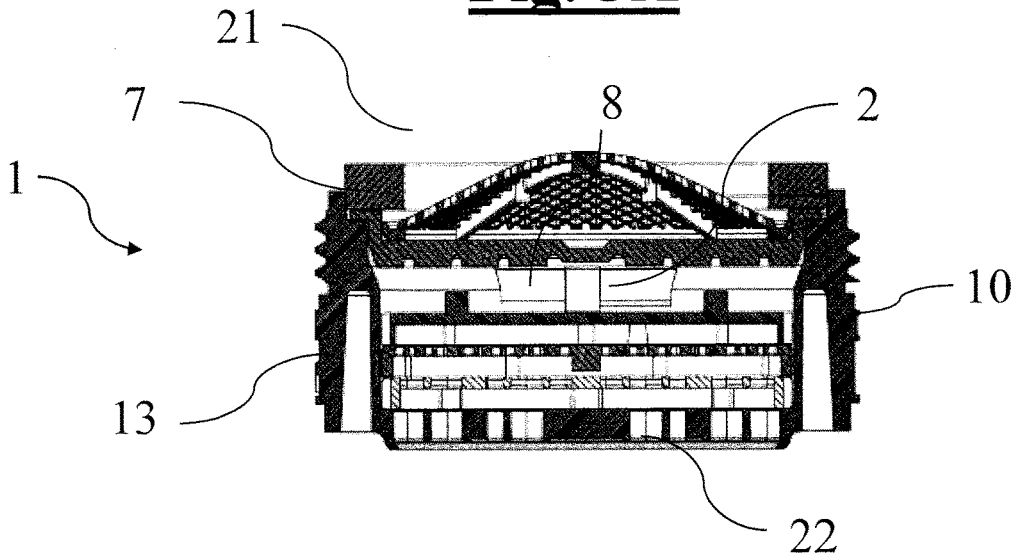
FIG. 3B shows a cross-sectional view, along a center plane orthogonal to the first plane, of the jet breaker cartridge according to FIG. 1.

As can be seen in particular in FIGS. 3A-3B, these breaking and aeration means consist of a jet breaker screen 3 situated upstream, an intermediate perforated plate 4 and a plurality of screening elements 5 situated downstream of the latter. Also downstream, at the outlet 22 of the flow path 2, there is a bottom grille 6 which is formed as one piece with the external casing.

It can be noted how the functional components described above are known per se to the person skilled in the art.

In the embodiment shown, the external casing 10, which as formed as a monolithic part, has a cup-shaped structure closed at the bottom by the bottom grille 6.

The successive screening elements 5, which in the example shown are three in number, are arranged above the bottom grille 6 and inside the aforementioned cup structure. The screening elements 5 are separated from each other by spacers which are formed as one piece with the single elements.

The cup-shaped structure 6 is closed at the top by the perforated plate 4 which snap-engages inside an upper flared portion thereof.

The perforated dome-like element which forms the jet breaker screen 3 is also arranged above the perforated plate, again by means of a circumferential snap-engaging joint.

A toroidal seal 7, which will be compressed inside the mouth 100, is positioned above the periphery of the perforated plate 4, enclosed within a cylindrical skirt of the external casing 10.

Of particular relevance with reference to the present invention is the external form of the aforementioned external casing 10, which is described in detail hereinbelow.

The external casing 10 has an engagement portion 11 provided on its external surface with a thread for screwing the cartridge 1 inside the mouth 100 and an underlying gripping portion 12 which is intended to be gripped by the operator and extends downstream with respect to the engagement portion 11 and is designed to extend beyond the edge of the mouth 100 of the faucet.

It should be noted in particular that, in order to ensure the correct positioning of the cartridge 1 with the gripping portion 12 exposed, the aforementioned thread has an end-of-travel stop forming a restraining abutment 16 at the transition point between the engagement portion 11 and the gripping portion 12.

The engagement portion 11 has a cylindrical configuration and is therefore entirely covered by the aforementioned thread; the underlying gripping portion 12 also has a central cylindrical body 15 with a diameter which, however, is substantially smaller than that of the engagement portion 11.

This central cylindrical body 15 coincides with the cup-shaped structure described above, namely defines internally a space inside which the various screening elements 5 are inserted.

The gripping portion 12 comprises, however, two diametrically opposed radial protrusions 13 which extend as far as the diameter of the engagement portion 11 and are connected above the latter.

In particular, each of the radial protrusions 13, which are in a relative mirror arrangement, has a cylindrical external wall section which extends continuously with the overlying gripping portion 12 and two flat walls which connect the cylindrical wall to the central cylindrical body 15.

The flat walls thus define a corresponding number of pushing and contact surfaces 14 for an operator's fingers, designed to allow manual screwing and unscrewing of the cartridge 1.

The operator, as shown in FIG. 1, is thus able to exert with the fingers of the hand two opposite pushing forces on the pushing surfaces 14 of the two radial protrusions, thus determining a torque for tightening or loosening the cartridge.

Figure 6:
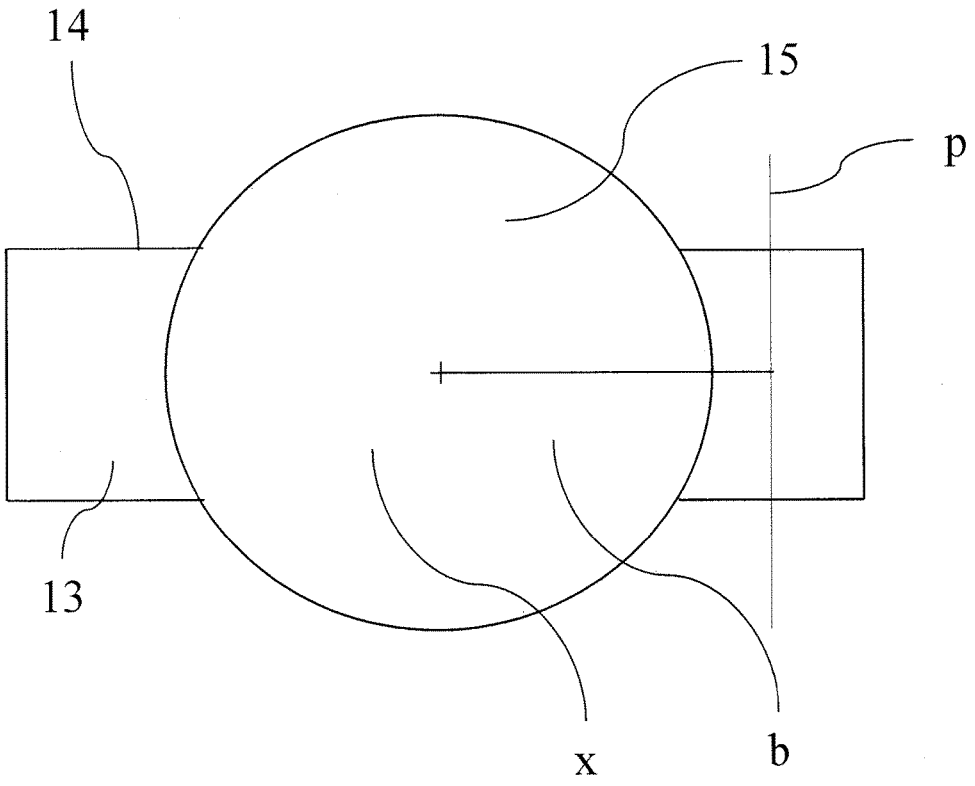
FIG. 6 shows a schematic view of the external profile of the jet breaker cartridge according to FIG. 1, in which a preferential direction of application of the tightening/loosening force is indicated.

With reference to FIG. 6, this shows in particular a preferential pushing direction p along which the force exerted by the operator during screwing or unscrewing is directed, said force passing through the barycentre of the pushing surface 14 and orthogonal thereto. It can be seen that this pushing direction is sufficiently far from the screwing axis x such as to ensure a high arm b multiplying the force exerted by the operator's fingers. This arm b is in particular equal to or greater than the diameter of the central cylindrical body 15.

It is pointed out, finally, the presence of two aeration windows 8, which are advantageously formed in the transition step between engagement portion 11 and gripping portion 2 of the external casing, where the radial protrusions 13 are absent.

Advantageously, the external casing 10 described above is formed as a monolithic plastic part, preferably made by means of injection-molding. The plastic used will be preferably a self-lubricating plastic, such as POM.

The thread of the cartridge 1 is therefore made of a material with a low coefficient of friction, so as to allow the operator to exert manually on the pushing surface 14 the force needed for screwing or unscrewing of the aerator, since the connection is less stable than that which occurs between two devices with a metal thread.

Below a second and a third embodiment of the cartridge 1', 1" are described, these being respectively illustrated in FIGS. 4 and 5. In the description of these embodiments, identical or similar parts have been assigned the same identification numbers previously used, followed by a single apostrophe mark for the second embodiment and a double apostrophe mark for the third embodiment.

The second embodiment, which is shown in FIG. 4, has a cartridge form which is substantially similar to that described above.

Unlike the first embodiment, however, the gripping portion 12' is a sleeve having a diameter the same as that of the engagement portion 11'.

It can be noted that this sleeve, which defines in this case the central cylindrical body 15', no longer coincides with the cup-shaped structure which contains the screening elements 5. In fact, between central cylindrical body 15' and cup-shaped structure there is an interspace 9' inside which openings (not visible in the figure) for aeration of the cup-shaped structure are formed.

In this embodiment the radial protrusions 13', which are two in number, are tabs which are arranged diametrically opposite each other with a longitudinal extension and diameter greater said engagement portion 11'.

These longitudinal tabs may help lock in position the cartridge 1', abutting against the mouth 100 of the faucet.

The third embodiment, which is shown in FIG. 5, also has a cartridge form which is substantially similar to those described above.

In this case, however, the external casing 10' is introduced for the most part inside the mouth 100 of the faucet; only an end portion of limited thickness extends outside the latter.

In this case, the radial protrusions 13" are planar teeth supported at the end of tongues 17" which adhere longitudinally to the central cylindrical body 15" of the device. The planar teeth extend outwards, defining an abutment against which the mouth 100 of the rests in the fastened configuration.

In this case, the abutting teeth are four in number, being spaced angularly at 90°. The pushing surfaces 14" are defined on the side surfaces of each single tooth.

Obviously a person skilled in the art, in order to satisfy any specific requirements which might arise, may make numerous modifications and variations to the invention described above, all of which are contained moreover within the scope of protection of the invention, as defined by the following claims.

The invention claimed is:

1. A jet breaker/aerator cartridge, screwable about a screwing axis within the mouth of a faucet, wherein a flow path is defined from an upstream inlet to a downstream outlet; said cartridge comprising:

an external casing, comprising therein at least one functional component configured to break up and enrich with air the water jet which strikes it, said functional component being positioned across said flow path;

said external casing featuring: an engagement portion provided with a thread on its external surface for screwing the cartridge within the mouth; and a gripping portion which extends downstream with respect to the engagement portion;

wherein said gripping portion features a central cylindrical body and at least one radial protrusion protruding therefrom, said protrusion defining two opposite pushing surfaces for an operator's fingers, so as to allow manual screwing and unscrewing of the cartridge, wherein said central cylindrical body features a diameter smaller than the engagement portion thereabove, said radial protrusions being two in number and having an external diameter equal to the engagement portion; the two pushing surfaces defined by one radial protrusion being aligned to the respective pushing surfaces of the other radial protrusion, each pushing surface being connected, through a portion of said central cylindrical body, with the aligned pushing surface.

2. The cartridge according to claim 1, comprising an abutment for restraining the motion of the cartridge within the mouth, so as to define a fastened arrangement wherein the gripping portion extends at least partially outside the mouth.

3. The cartridge according to claim 2, wherein in said fastened arrangement the pushing surface protrudes outside the mouth.

4. The cartridge according to claim 1, wherein at least a pushing direction orthogonal to said pushing surface is eccentric with respect to said screwing axis by an arm at least equal to the radius of the central cylindrical body.

5. The cartridge according to claim 1, wherein said external casing is made of plastic material.

6. The cartridge according to claim 5, wherein said external casing is made of self-lubricating plastic material.

7. The cartridge according to claim 1, wherein said external casing is monolithic and said central cylindrical body internally defines a cup containing the at least one functional component.

8. A faucet comprising: a mouth; and a jet breaker/aerator cartridge, wherein a flow path is defined from an upstream inlet to a downstream outlet; said cartridge comprising: an external casing, comprising therein at least one functional component configured to break up and enrich with air the water jet which strikes it, said functional component being positioned across said flow path; said external casing featuring: an engagement portion provided with a thread on its external surface for screwing the cartridge within the mouth; and a gripping portion which extends downstream with respect to the engagement portion; wherein said gripping portion features a central cylindrical body and at least one radial protrusion protruding therefrom, said protrusion defining a pushing surface for an operator's fingers, so as to allow manual screwing and unscrewing of the cartridge, wherein the thread of the engagement portion is screwed about a screwing axis within a corresponding inner thread in the mouth up to reaching a mounted arrangement wherein an abutment of said cartridge abuts against a portion of said mouth thereby restraining the motion of the cartridge within the mouth; said at least one pushing surface being accessible to an operator's fingers in said mounted arrangement, so as to allow manual unscrewing of the cartridge from the mouth.

9. The faucet according to claim 8, wherein said at least one pushing surface extends at least partially outside the mouth, so as to allow contact thereupon by an operator's fingers.

10. A jet breaker/aerator cartridge, screwable about a screwing axis within the mouth of a faucet, wherein a flow path is defined from an upstream inlet to a downstream outlet; said cartridge comprising: an external casing, comprising therein at least one functional component configured to break up and enrich with air the water jet which strikes it, said functional component being positioned across said flow path; said external casing featuring: an engagement portion provided with a thread on its external surface for screwing the cartridge within the mouth; and a gripping portion which extends downstream with respect to the engagement portion; wherein said gripping portion features a central cylindrical body and at least one radial protrusion protruding therefrom, said protrusion defining a pushing surface for an operator's fingers, so as to allow manual screwing and unscrewing of the cartridge, wherein said radial protrusion radially extends beyond a radius of said threaded external surface, said radial protrusion featuring an abutment surface, orthogonal to the screwing axis and facing upstream, configured to abut against the mouth in a fastened arrangement of the cartridge.

11. The cartridge according to claim 10, wherein said radial protrusions are at least two, diametrically opposed with respect to the central cylindrical body, each of said radial protrusions featuring a respective pushing surface.

12. The cartridge according to claim 10, wherein said central cylindrical body has a diameter equal to the engagement portion, said radial protrusions being two longitudinal tabs.

13. The cartridge according to claim 10, wherein said radial protrusions are teeth, abutting against the mouth in a fastened arrangement of the cartridge.

14. The cartridge according to claim 10, wherein at least a pushing direction orthogonal to said pushing surface is eccentric with respect to said screwing axis by an arm at least equal to the radius of the central cylindrical body.

15. The cartridge according to claim 10, wherein said external casing is made of plastic material.

16. The cartridge according to claim 15, wherein said external casing is made of self-lubricating plastic material.

17. The cartridge according to claim 14, wherein said external casing is monolithic and said central cylindrical body internally defines a cup containing the at least one functional component.

* * * * *